US007053552B2

(12) United States Patent
Yonehara et al.

(10) Patent No.: US 7,053,552 B2
(45) Date of Patent: May 30, 2006

(54) PLASMA DISPLAY PANEL HAVING END PORTIONS OF BARRIER RIBS ADJUSTED TO AVOID VERTICAL SWELLING

(75) Inventors: Hiroyuki Yonehara, Hirakata (JP); Hideki Ashida, Kadoma (JP); Shinya Fujiwara, Kyoto (JP); Yasuyuki Akata, Takatsuki (JP); Sadao Uemura, Takatsuki (JP); Shigeo Suzuki, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/639,027

(22) Filed: Aug. 11, 2003

(65) Prior Publication Data

US 2004/0046504 A1 Mar. 11, 2004

Related U.S. Application Data

(62) Division of application No. 09/769,893, filed on Jan. 25, 2001, now Pat. No. 6,646,376.

(30) Foreign Application Priority Data

Jan. 26, 2000 (JP) ..... 2000-016734
Jan. 27, 2000 (JP) ..... 2000-018410

(51) Int. Cl.
*H01J 17/49* (2006.01)

(52) U.S. Cl. ..... 313/582; 313/609; 313/610

(58) Field of Classification Search ..... 313/582, 313/584, 586, 609, 610; 445/24, 25
See application file for complete search history.

(56) References Cited

U.S. PATENT DOCUMENTS

| | | | | |
|---|---|---|---|---|
| 5,670,843 | A * | 9/1997 | Matsuura | 313/582 |
| 5,984,747 | A | 11/1999 | Bhagavatula et al. | |
| 6,008,582 | A | 12/1999 | Asano et al. | |
| 6,109,994 | A * | 8/2000 | Cho et al. | 445/25 |
| 6,149,482 | A | 11/2000 | Sakasegawa et al. | |
| 6,184,621 | B1 | 2/2001 | Horiuchi et al. | |
| 6,249,264 | B1 * | 6/2001 | Sano et al. | 345/60 |
| 6,373,190 | B1 | 4/2002 | Tsuruoka et al. | |
| 6,414,435 | B1 | 7/2002 | Akiba | |
| 6,433,471 | B1 | 8/2002 | Khan et al. | |

FOREIGN PATENT DOCUMENTS

| | | |
|---|---|---|
| EP | 935275 | 8/1999 |
| JP | 4-62741 | 6/1990 |

(Continued)

*Primary Examiner*—Nimeshkumar D. Patel
*Assistant Examiner*—Matt Hodges

(57) ABSTRACT

It is aimed to provide a technique for easily suppressing swellings produced in end parts of partitions, thereby achieving a PDP capable of displaying a high-quality image.

A PDP therefore has a plurality of partitions that include: (a) a plurality of main parts; and (b) a plurality of sub parts that each extend from an end part of one of the plurality of main parts parallel to a direction perpendicular to a direction in which the main parts extend. This allows each partition to have an end that is wider than a center part of the partition.

In the process of forming PDP partitions, end parts of the partitions are partially heated, after they are baked, to a temperature higher than a softening point of a partition material. As a specific partial heating method, a method with which a laser beam is projected onto an end part is suitable.

8 Claims, 8 Drawing Sheets

FOREIGN PATENT DOCUMENTS

| | | | |
|---|---|---|---|
| JP | 5-342992 | | 6/1992 |
| JP | 06150832 | A | 5/1994 |
| JP | 08-315737 | | 11/1996 |
| JP | 10188791 | A | 7/1998 |
| JP | 11-135017 | | 5/1999 |
| JP | 11 135025 | | 5/1999 |
| JP | 2000-011865 | | 1/2000 |
| JP | 2000 48714 | | 2/2000 |
| JP | 2000-11865 | | 1/2002 |

* cited by examiner

PLASMA DISPLAY PANEL HAVING END PORTIONS OF BARRIER RIBS ADJUSTED TO AVOID VERTICAL SWELLING

The present application is a divisional application of Ser. No. 09/769,893 U.S. Pat. No. 6,646,376 filed on Jan. 25, 2001.

BACKGROUND OF THE INVENTION (1) Field of the Invention

The present invention relates to a plasma display panel (PDP) used such as for a display device, and to a PDP production method.

(2) Description of the Prior Art

A plasma display panel (PDP) has recently received much attention as a flat panel display used in computers and televisions.

A PDP is classified as one of two major types, namely a DC-type and an AC-type, of which the latter has become mainstream because it is suitable for use in a large display.

To illuminate discharge cells of an AC-type PDP, an AC pulse voltage is applied to electrodes covered by a dielectric layer that sustains a discharge. With an AC-type PDP, a surface-discharge type and an opposed-discharge type are widely known. For the surface-discharge type, pairs of sustained electrodes are placed in parallel on a front panel. For the opposed-discharge type, pairs of sustained electrodes are placed on both the front panel and the back panel, and so the pairs of sustained electrodes face one another.

FIG. 10 shows a standard AC surface-discharge PDP as one example.

For this PDP, a front panel 110 and a back panel 120 face each other, and outer parts (not shown in the figure) of their facing surfaces are bonded with a sealing material made of low-melting glass.

For the front panel 110, pairs 112*a*–112*b* of display electrodes are formed on a front substrate 111 on a side facing the back panel 120. A dielectric layer 113 made of dielectric glass, and a protecting layer 114 made of magnesium oxide (MgO) cover the display electrode pairs 112*a* and 112*b*.

For the back panel 120, address electrodes 122 are formed in parallel at certain intervals on a back substrate 121 on a side facing the front panel 110. A back dielectric layer 123 covers the address electrodes 122, and partitions 130 are formed in parallel at certain intervals on the back dielectric layer 123 along the address electrodes 122. Phosphor layers 140 for respective colors (red, green, and blue) are formed in channels between the partitions 130.

With the above construction, the display electrode pairs 112*a* and 112*b* are placed perpendicular to the address electrodes 122. At intersections of the display electrode pairs 112*a*–112*b* and the address electrodes 122, discharge cells are formed.

Based on image data to be displayed, an address pulse voltage is first placed between the address electrodes 122 and the display electrode pair 112*a*. After this, a sustain pulse voltage is placed between the display electrode pair 112*a* and 112*b*. This causes a sustained discharge to occur selectively in the discharge cells, so that ultraviolet rays are emitted from the discharge cells where the sustained discharge occurs. The emitted ultraviolet rays excite the RGB phosphor layers 140, which then emit visible light, so that images are displayed on the PDP.

Adjacent discharge cells are separated by the partitions 130, which prevent a crosstalk phenomenon, i.e., a state in which discharges at different discharge cells mix, from occurring.

The partitions 130 are usually produced by having a partition material such as a glass material formed into a partition pattern (i.e., stripes) and baking the formed partition material at a temperature higher than a softening point of the glass material contained in the partition material. There are three major partition forming methods as follows. The first one is called a "printing method", with which a partition pattern is printed using a paste containing the partition material, such as by the screen printing. The second method is called a "sandblasting method". For this method, the above paste is applied onto the entire surface of the back substrate, and then a photosensitive film layer is formed on this paste. The predetermined partition pattern is then formed using photography. After this, unnecessary paste is removed by sandblasting. The third method is called a "photo-paste method". In this method, a photosensitive paste containing the partition material is applied onto the entire surface of the back substrate, and then unnecessary portions are removed using photography.

When a partition material is formed into a partition pattern using any of the above three partition forming methods and then baked, an end part 130*a* of a resulting partition 130 swells and becomes higher than other parts, such as a part 130*a*. When compared with the part 130*b*, this end part 130*a* becomes high by ten to twenty percent.

A swelling such as in the end part 130*a* is likely to be generated especially when the partitions 130 are formed on the back dielectric layer 123 on the back substrate 121.

The swellings in the end parts of the partitions 130, however, make it difficult to join a back substrate and a front substrate together without leaving any gaps between the partitions 130 and the front substrate during an assembly of a PDP. When this PDP with gaps is driven, an improper discharge or an abnormal discharge is likely to occur in adjacent cells. In addition, due to the above gaps, the front panel vibrates, so that noise is likely to be generated.

SUMMARY OF THE INVENTION

The present invention is therefore made in view of the above problems, and aims to provide a technique for easily producing partitions whose end parts do not swell, thereby providing a PDP capable of displaying a high-quality image.

To solve the above problems, the partitions of a PDP according to the present invention include a plurality of main parts that extend parallel to either first electrodes or second electrodes. Each main part contains an end part and a central part, and the end part is wider than the central part.

When the above partitions are baked, no swellings are produced in their end parts.

Note that for forming a partition patter, standard processes such as the "sandblasting method" and the screen printing method can be used.

The following describes reasons why the partitions of the present invention prevent swellings from being produced in the end parts of the partitions.

Usually, a partition material tries to contract during baking, so that large tension is exerted parallel to the longitudinal direction of main parts. A central part of a main part is pulled toward two opposite directions that are parallel to the longitudinal direction of the main part. On the other hand, an end part of the main part is pulled toward the center, but not pulled toward the direction opposite to the center.

A swelling is therefore considered to be produced when the partition material making up a portion near the surface of the end part moves due to the pulling force exerted to the end part toward the center.

When a main part has an end part that is wider than a central part, the pulling force is distributed over the wide end part so that the movement of the partition material can be suppressed. Moreover, when the end part of the main part extends parallel to the direction of the main part's width in this way, tension is exerted parallel to the width direction as well as toward the center. This tension parallel to the width direction is also considered to suppress swellings.

To make a width of the end part larger than that of the central part, the end part may have a shape whose cross section is similar to either a letter "T" or a letter "L".

In order to allow each partition to have ends that are wider than a center of the partition, a sub part is provided to each main part for the present invention. This sub part extends from an end part of the main part parallel to a direction of a width of the main part.

When end parts of every two adjacent main parts are connected with one another by such a sub part, large tension is exerted parallel to the direction in which the sub part extends. This construction is effective in suppressing swellings in the end parts.

It is desirable that a sub part has a larger width than a main part, preferably at least 1.5 times as large as a main part, so as to have sufficiently large tension exerted parallel to the direction in which sub parts extend. However, when end parts of all the main parts are connected with one another by sub parts, the above sufficiently large tension can be still exerted even if sub parts have a narrower width than main parts.

Also with the present invention, end parts of partitions are partially heated, after the partitions are baked, to a temperature higher than a softening point of a partition material during the partition forming process. As a result, when the end parts swell after the baking process, the swellings can be reduced by the partial heating process for reasons described below.

When an end part is partially softened by the heating and then solidifies, surfacetension is exerted to this end part. As a result, the partition material making up a swelling in the end part disperses to its periphery.

As a specific partial heating method, a method with which a laser beam is projected onto an end part of each partition is suitable.

For the reasons described above, the present invention can suppress swellings produced in end parts of partitions of a PDP. As a result, a gap is not likely to be produced between the partitions and a substrate facing the partitions. This prevents an improper discharge and an abnormal discharge from occurring in adjacent cells during driving of the PDP. In addition, vibration of a substrate during the driving can be prevented.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

FIRST EMBODIMENT

Overall Construction of PDP

Figure 1:
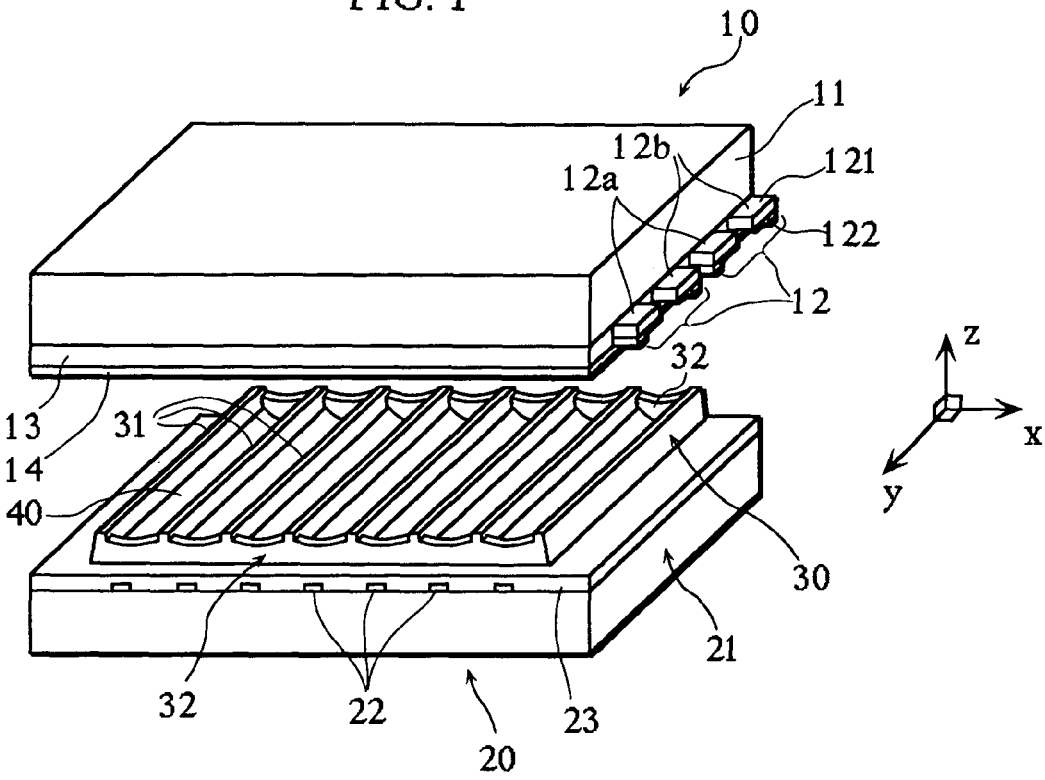
FIG. 1 shows major parts of an AC surface-discharge PDP of the first embodiment of the present invention in perspective view.

FIG. 1 shows major parts of an AC surface-discharge PDP of the first embodiment of the present invention in perspective view.

This PDP comprises a front panel 10 and a back panel 20. The front panel 10 contains a front glass substrate 11, on which display electrode pairs 12, a transparent dielectric layer 13, and a protecting layer 14 are formed. The display electrode pairs 12 each consist of a scanning electrode 12*a* and a sustaining electrode 12*b*. The back panel 20 contains a back glass substrate 21, on which address electrodes 22 and a back dielectric layer 23 are formed. The front panel 10 and the back panel 20 are placed in parallel in a manner that has the display electrode pairs 12 face the address electrodes 22 and that leaves certain space between the front panel 10 and the back panel 20.

The display electrode pairs 12 and the address electrodes 22 are formed in stripes. The display electrode pairs 12 are positioned in parallel to the longitudinal direction of the back glass substrate 21, i.e., parallel to a the x-axis direction shown in the figure. The address electrodes 22 are positioned in parallel to the y-axis direction, which is perpendicular to the above longitudinal direction. At intersections of the display electrode pairs 12 and the address electrodes 22, cells are formed and emit red, green, and blue light.

The address electrodes 22 are made of metal (e.g., silver or Cr—Cu—Cr).

The display electrode pairs 12 may be made of metal like the address electrodes 22 although the figure shows each of the display electrode pairs 12 as being composed of a transparent electrode 121 of a larger width and a bus electrode 122 of a smaller width that are layered. The transparent electrode 121 may be made of materials such as ITO, $SnO_2$, and ZnO, and the bus electrode 122 may be made of silver or Cr—Cu—Cr.

The transparent dielectric layer 13 covers the entire surface of the front glass substrate 11, on which the display electrode pairs 12 are also positioned. The transparent dielectric layer 13 is made of a dielectric material, such as a low-melting lead glass, or a low-melting bismuth glass.

The protecting layer 14 is a thin layer made of magnesium oxide (MgO), and covers the entire surface of the transparent dielectric layer 13.

The partitions 30 are formed on the back dielectric layer 23 of the back panel 20. The distance between the front panel 10 and the back panel 20 is determined in accordance with these partitions 30. The partitions 30 include main parts 31 and sub parts 32. Each of the sub pats 32 extends from an end part of one main part 31 to an end part of another main part 31. The partitions 30 are described in detail later.

The main parts 31 are positioned above intervals of two adjacent address electrodes 22. In channels between the main parts 31, the phosphor layers 40 for red, green, and blue are formed. A discharge gas is filled into these channels between the main parts 31, and discharge spaces are formed in the channels.

When used for a high-definition television with 40-inch diagonal screen, this PDP usually has the following dimensions.

The address electrodes 22 are placed at an interval of 0.2 mm or shorter, and the main parts 31 are placed at an interval of 360 μm. Each main part 31 has a 50~100 μm-wide top surface facing the front panel 10, and is 100~150 μm high.

As the discharge gas, rare gas composed of He, Ne, and Xe is filled into the discharge spaces at the pressure of 66.5~80 kPa.

When this PDP is driven, an address pulse voltage is impressed to the scanning electrodes 12*a* and the address electrodes 22 by using a driving circuit (not shown in the figure), so that a wall electric charge is accumulated in each discharge cell. After this, a sustained-discharge pulse voltage is impressed between the scanning electrodes 12*a* and the sustaining electrodes 12*b*. As a result, a sustained discharge occurs at the cells that have accumulated the wall electric charge, so that these cells emit light. When these operations are repeated, an image is displayed in an image display area in the center of the PDP.

Partition Configuration

Figure 2:
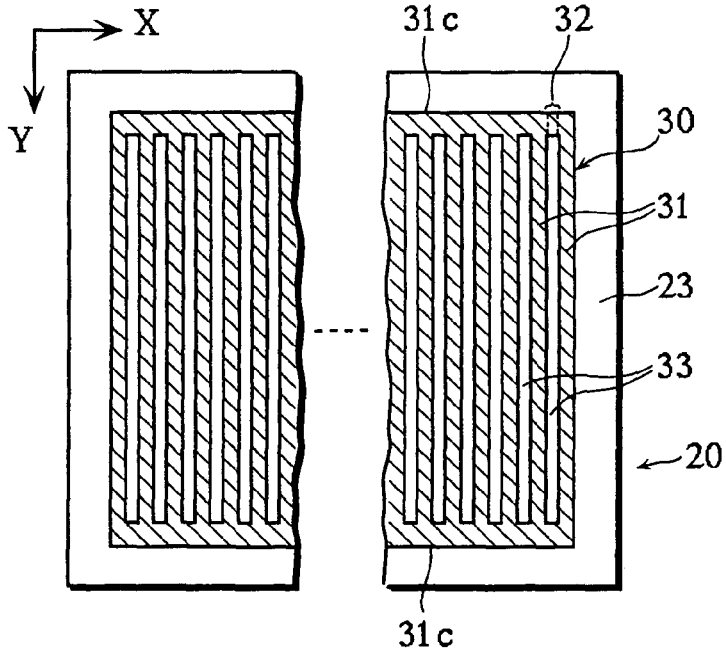
FIG. 2 is a plain view of partitions formed on a back dielectric layer on a back panel of the above PDP.

FIG. 2 is a plain view of the partitions 30 formed on the back dielectric layer 23 on the back panel 20.

The partitions 30 include the main parts 31 and the sub parts 32. The main parts 31 extend along the address electrodes 22 parallel to the y-axis direction. The sub parts 32 extend parallel to the x-axis direction and connects end parts of the main parts 31 with one another. Channels 33 are formed by adjacent main parts 31.

Here, an "end part" of each main part 31 refers to a part which extends from an end 31*c* of the main part 31 in parallel to the y-axis direction by a length approximately equal to a width of the main part 31.

PDP Production Method

The following describes a method for producing the above PDP.

(A) Front Panel Producing Process

The front glass substrate 11 is made of soda glass that is approximately 2.8 mm thick. On the surface of the front glass substrate 11, the plurality of transparent electrodes 121 are formed in parallel to one another. Each of the transparent electrodes 121 is made of a conductive material such as ITO (indium tin oxide) or $SnO_2$ and is 3,000 angstroms thick. The bus electrodes 122 made of silver or three layers composed of Cr—Cu—Cr are layered on the transparent electrodes 121, so that the display electrode pairs 12 are formed.

The above electrodes can be produced using a conventional method, such as screen printing and the photolithography.

Following this, the entire surface of the front glass substrate 11, on which the display electrode pairs 12 are formed, is coated with a dielectric paste containing lead glass. The coated front glass substrate 11 is then baked so that the transparent dielectric layer 13 of about a 20~30 μm thickness is formed. On the surface of this dielectric layer 13, the protecting layer 14 made of MgO is formed with a vapor deposition method or a chemical vapor deposition (CVD) method. As a result, the front panel 10 is produced.

(B) Back Panel Producing Process

The back glass substrate 21 is made of 2.6 mm-thick soda glass. Onto the surface of this back glass substrate 21, a conductive silver material is applied in stripes by performing the screen printing. This produces the address electrodes 22 that are about 5~10 μm thick.

Following this, the entire surface of the back glass substrate 21, on which the address electrodes 22 are formed, is coated with a dielectric glass paste. The coated back glass substrate 21 is then baked so that the back dielectric layer 23 of an approximately 20~30 μm thickness is formed.

After this, the partitions 30 are formed using methods such as the "sandblasting method" which is described later.

Phosphor pastes for three colors composed of red, green, and blue are applied onto channels 33 formed by adjacent partitions 30 by performing the screen printing. The applied phosphor pastes are then baked in the air, so that phosphor layers 40 for the three colors are formed. As a result, the back panel 20 is produced.

As a method for forming the phosphor layer 40, a method other than the screen printing may be used. For instance, the phosphor layer 40 can be formed by having a nozzle inject a phosphor ink, or by attaching a photosensitive resin sheet containing a phosphor material for each color onto the partitions 30 and the channels 33, performing patterning by the photolithography, and developing the pattern.

(C) Processes for Sealing, Exhausting, and Discharge-Gas Filling

As a sealing material, a sealing glass frit paste is applied to outer parts of at least one of: (a) a facing surface of the front panel 10; and (b) that of the back panel 20. This generates a sealing material layer. After this, the front panel 10 and the back panel 20 are combined in a manner that has the display electrode pairs 12 and the address electrodes 22 face perpendicular to one another. The applied sealing material is then heated to make it soft and bond the front panel 10 and the back panel 20 together.

After this, the bonded two panels 10 and 20 are heated at 350° C. for three hours while gases are exhausted from inner space of the bonded panels at the same time. The discharge gas is then filled into the inner space at a predetermined pressure. This completes production of the PDP.

Partition Forming Process Using Sandblasting Method

FIGS. 3A–3D respectively show the first to forth steps of the partition forming process that uses the "sandblasting method".

The first step is a partition layer coating step, and the second step is a photosensitive layer pattern forming step. The third step is the blasting step, and the fourth step is the covering layer removing step. The above partition forming process also includes a partition baking step as the fifth step. The following describes these steps separately.

(a) Partition Layer Coating Step

An organic solvent is produced by mixing α-terpineol and EP acetic acid diethylene glycol mono n butyl ether (BCA) at a weight ratio of 50:50. This organic solvent is then mixed with high polymer resin ethyl cellulose to produce vehicle.

Lead glass ($PbO—B_2O_3—SiO_2—CaO$, which is similar to the lead glass used for the dielectric paste) powder, filler powder (aggregate) made of alumina, and pigment powder made of titanium oxide ($TiO_2$) are mixed at a weight ratio of 80:10:10 to produce a partition material mixture. This partition material mixture is mixed with the above vehicle to produce a partition paste.

This partition paste is uniformly applied to a center part of the back dielectric layer 23. This center part corresponds to a part that displays images. The screen printing is performed for the applied partition paste, and the printed partition paste is dried. This process is repeated to form the partition layer 300 of an approximately 150-μmm thickness.

(b) Photosensitive Layer Pattern Forming Step

A covering layer 310 made of a photosensitive material is formed on the partition layer 300 produced in the first step. For the present embodiment, the covering layer 310 is formed by performing laminating on a 50 μ-thick photosensitive dry film resist (hereafter called "DFR").

After this, a photomask is positioned on the covering layer 310. This photomask only covers parts of the covering layer 310 that correspond to a pattern (see FIG. 2) of the partitions 30. The photomask on the covering layer 30 is irradiated with ultraviolet (UV) light for an exposure. The appropriate light exposure is set in accordance with a width and a pitch of the partition pattern of the photomask.

After this, development is performed using a developer made of an aqueous solution having a sodium carbonate concentration of one percent. Immediately after the development, the structure on which the irradiated photomask is present is washed with water. As a result, channels 311 are produced in stripes on the covering layer 310. These channels 311 correspond to the channels 33 formed between main parts 31 shown in FIG. 2. A width of a channel 311 is typically 80 μm on its top, and a pitch of the channels 311 is 360 μm.

(c) Blasting Step

After the partition pattern is made on the covering layer 310, the sandblasting is performed on the partition layer 300.

Figure 3A:
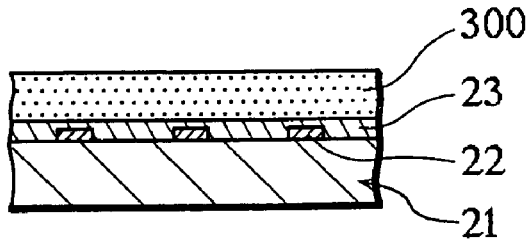
FIGS. 3A–3D show the first to forth steps of a partition forming process that uses the "sandblasting method"
Figure 3B:
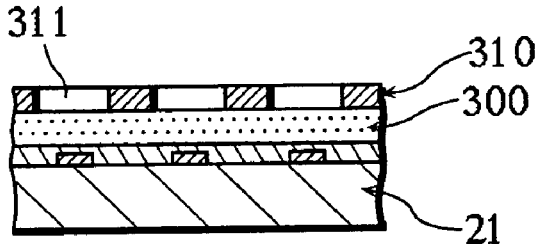
Figure 3C:
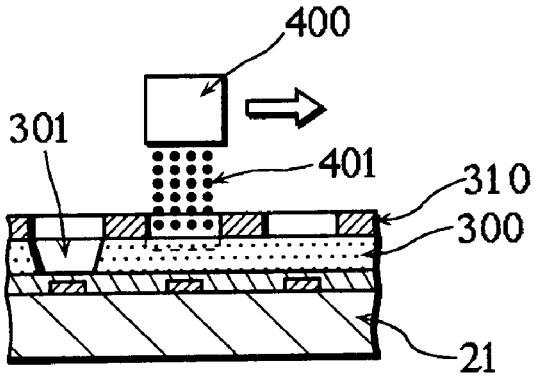
Figure 3D:
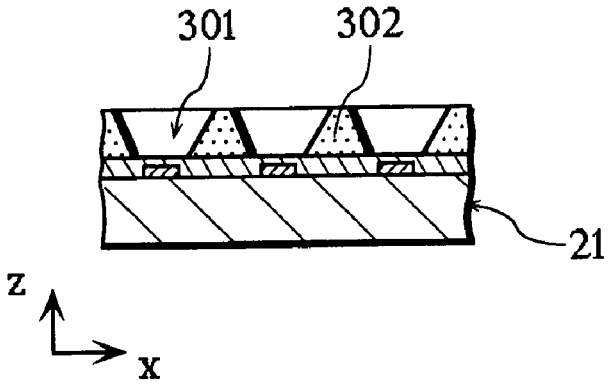

In more detail, an abrasive 401, such as a glass bead material, of 1500 g/minute is injected from a blast nozzle 400 to the structure shown in FIG. 3B at an air flow rate of 1500 NL/minute. This blast nozzle 400 is moved across the surface of the covering layer 310 as shown by an arrow in FIG. 3C.

The blast nozzle 400 may have the same length as a length in the y-axis direction of the channels 33 and be moved in the x-axis direction. Alternatively, the blast nozzle 400 of a shorter length may be used. In this case, the nozzle 400 may be moved parallel to the y-axis direction while being moved slowly parallel to the x-axis direction.

By injecting a blast of the abrasive 401 across the surface of the covering layer 310 in this way, parts of the partition layer 300 that are exposed through the channels 311 are removed, and the channels 301 are formed.

The sandblasting is typically performed until all the parts of the partition layer 300 that correspond to the channels 301 are removed.

(d) Covering Layer Removing Step

The back glass substrate 21, on which the channels 310 are formed, is then immersed in an exfoliation liquid, such as an aqueous solution having a sodium hydroxide concentration of five percent, to remove the covering layer 310.

Figure 4B:
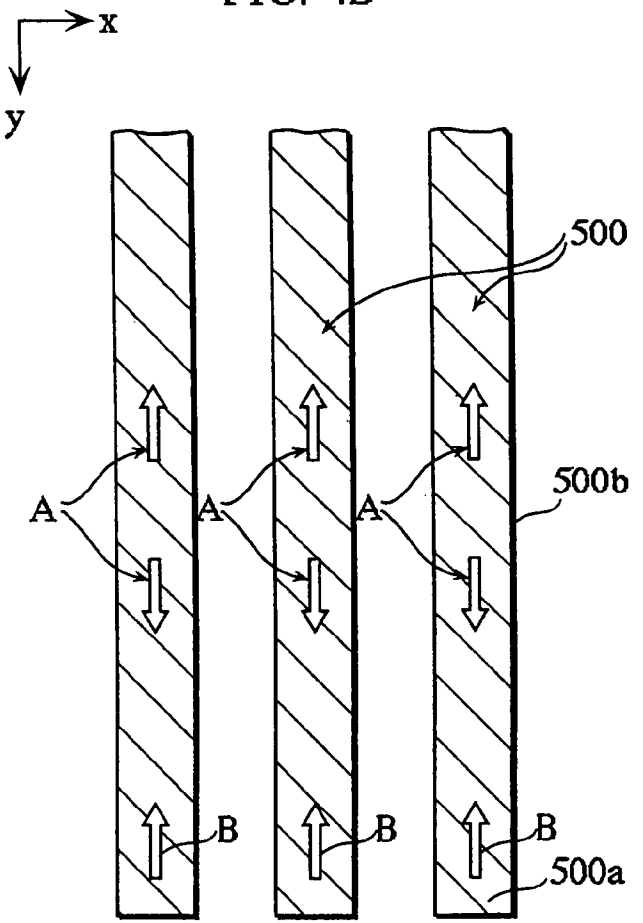
FIG. 4B PRIOR ART
FIG. 4B is a magnified view of a part of conventional partitions before they are baked.
Figure 4A:
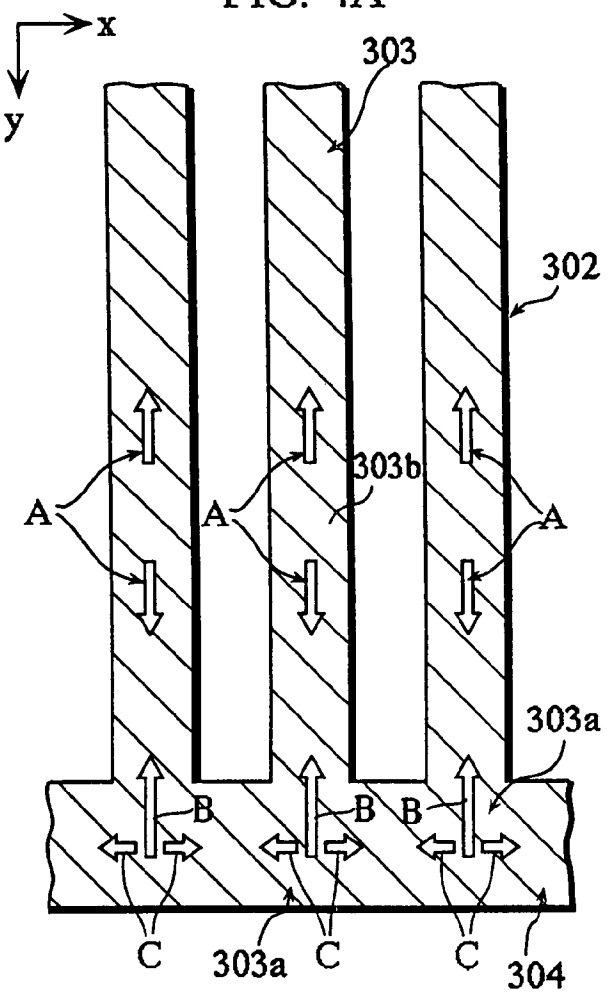
FIG. 4A is a magnified view of a part of partitions of the first embodiment before they are baked.

FIG. 4A is a magnified view of a part of partitions 5 302 obtained as a result of the above steps before the baking step.

The pattern of these partitions 302 are basically the same as the pattern of the partitions 30 shown in FIG. 2. For the partitions 302, main parts 303 (which corresponds to the main parts 31 in FIG. 2) extend parallel to the y-axis direction, and the sub parts 304 (which corresponds to the sub parts 32) extend parallel to the x-axis direction and connect end parts 303*a* of the main parts 303.

(e) Partition Baking Step

The back glass substrate 21, from which the covering layer 310 is removed, is heated inside a baking furnace, whose peak temperature is set slightly higher (at around 550° C.) than a softening point of the partition material. As a result, the partition material of the partitions 302 is sintered as the partitions 30.

During this baking, generation of swellings in an end part 303*a* of a main part 303 can be suppressed due to the sub parts 304 formed beside the main parts 303 for the reasons described later.

When such swellings in the partitions 30 are reduced, the gaps between the partitions 30 and the front panel 10 can be minimized. This prevents an improper discharge and an abnormal discharge from occurring during driving of the PDP. In addition, it is possible to prevent the front panel 10 from vibrating.

Effect of Sub Parts Preventing Swellings

The following describes the effect of sub parts reducing swellings.

FIG. 4B is a magnified view of a part of conventional partitions 500 arranged in stripes before they are baked. These partitions 500 have a similar shape to the partitions 130 of the conventional PDP that was described earlier.

Usually, a partition material contracts during the baking, so that tension is exerted parallel to the y-axis direction on both the main parts 302 in FIG. 4A and main parts 500.

With the main parts 303 and 500 in FIGS. 4A and 4B, central parts 303*b* and 500*b* are pulled toward opposite directions along the "y" axis as shown by white arrows "A". Here, the central parts 303*b* and 500*b* refer to a part of a main part that excludes an end part 303*a* and an end part 500*a*, respectively.

On the other hand, the end parts 303*a* and 500*a* of the main parts 303 and 500 are pulled toward the center, as shown by white arrows "B" although these end parts 303*a* and 500*a* are not pulled toward the opposite direction.

Accordingly, with the conventional partitions 500, this tension toward the center moves the partition material present near the surface of the end parts 500*a* toward the center. This movement occurs especially near very ends of the main parts 500. It is therefore considered that a swelling is produced when the partition material is centered onto such a narrow end part 500*a*.

With the present partitions 302 of FIG. 4A, the tension shown by the arrows "B" is exerted onto their end parts 303*a*. However, this tension is also distributed to the sub parts 304, which extend from these end parts 303*a* in the x-axis direction. This suppresses the above movement of the partition material. Should the partition material present near ends of the end parts 303*a* move toward the central parts 303*b*, however, the partition material would also move toward the sub parts 304. As a result, swellings are unlikely to occur in the end parts 303*a*.

In addition, when the sub parts 304 try to contract parallel to their extending direction, i.e., the x-axis direction, tension is exerted on the end parts 303*a* in the x-axis direction as shown by white arrows "C". It can be therefore analyzed that this tension on the end parts 303*a* lowers the height of the end parts 303*a*.

Note that when the sub parts 304 have a longer length in the y-axis direction, larger tension is exerted on the end parts 303*a* during baking (hereafter, this length in the y-axis direction is referred to as a "width" of the sub parts 304). Accordingly, it is desirable that the sub parts 304 have a larger width (from 1.5 times to twice) than the main parts 303 so as to lower the height of the baked end parts 31*a* and that of the baked sub parts 32.

Figure 5:
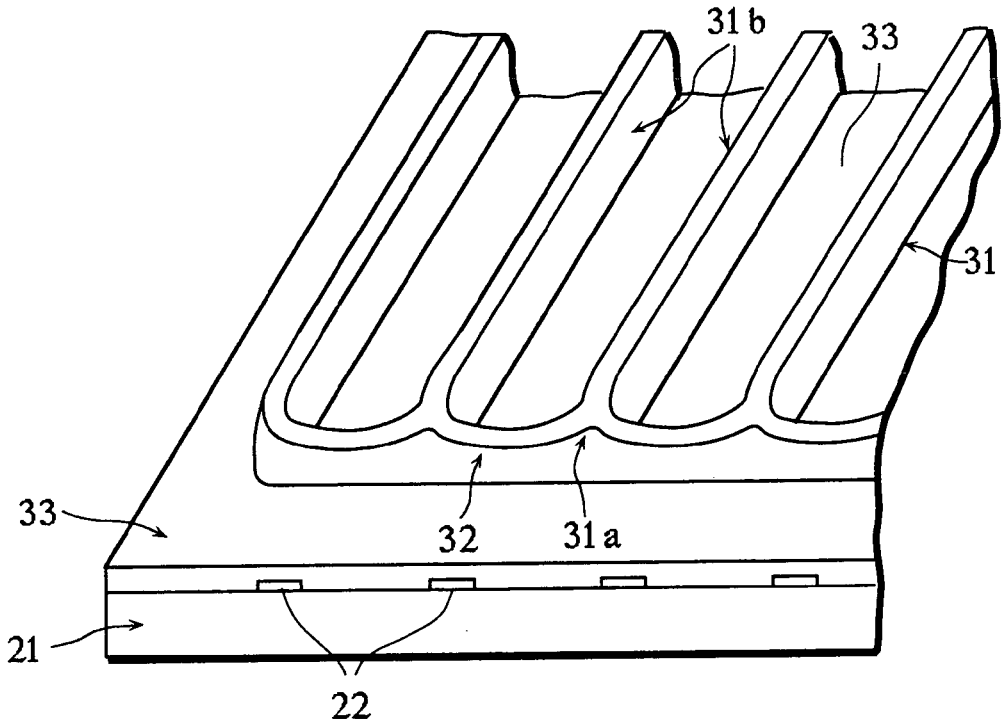
FIG. 5 is a magnified view of partitions of the PDP according to the first embodiment.

In this way, when the width and the length (which is parallel to the x-axis direction) of the sub parts 304 are lengthened, larger tension is produced along the x-axis direction, i.e., the direction of the width of the main parts 303 although conditions during the baking may have some effects on generation of such tension. As a result, as shown in FIG. 5, it becomes possible that the central parts 31*b* of the main parts 31 have a higher height than the end parts 31*a* and the sub parts 32.

Figure 6:
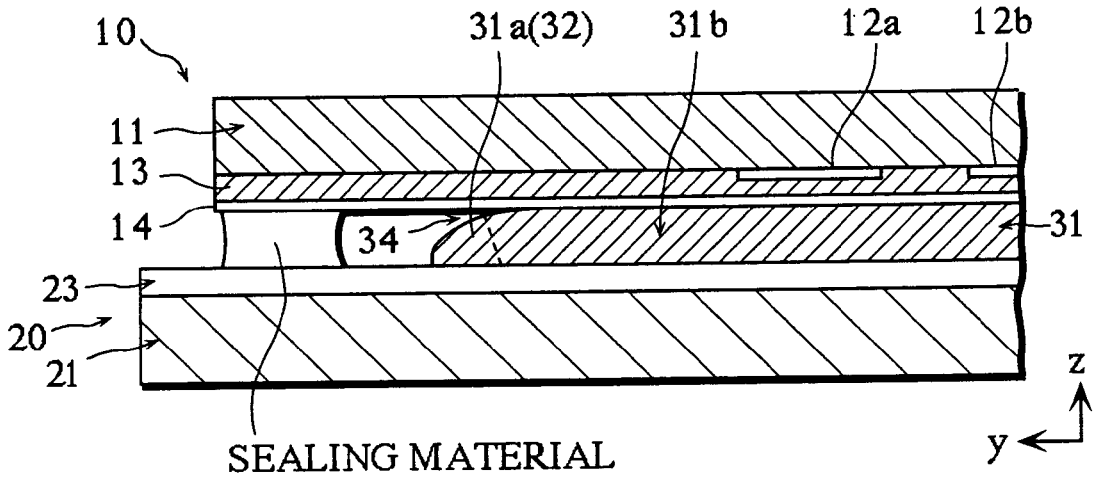
FIG. 6 is a cross sectional view showing characteristics of the above PDP.

When the front panel 10 and the back panel 20, which includes the sub parts 32 having a lower height than the central parts 31*b*, are joined together in the sealing process, a space 34 is left, as shown in FIG. 6, between a sub part 32 and the front panel 10. Accordingly, in the exhausting and discharge-gas filling process that follows the sealing process, exhausting and filling of the discharge gas can be efficiently performed thorough this space 34 connecting the inside (i.e., a channel 33) with the outside (i.e., the sub parts 32 and the sealing material) of the sub part 32.

Note that sufficiently large tension can be produced parallel to the x-axis direction during the baking even when the sub parts 304 have a narrower width than the main parts 303 if the sub parts 304 are formed in a manner that connects the end parts 303*a* of all the main parts 303. This allows the end parts 31*a* and the sub parts 32 to have approximately the same height as the central parts 31*b* of the main parts 31.

Modification Examples of Partition Pattern

As shown in FIGS. 1 and 2, the partitions 30 have been described as including the sub parts 32 that connect end parts of all the main parts 31 so as to suppress swellings in the end parts. However, this effect can be also achieved if an end of each partition is wider than the central part of the partition.

FIGS. 7A–7D show example modifications of the partitions 30, which are shown as being shaded. These modification partitions are the same as the partitions 30 described above in that the main parts 31 are arranged in stripes and that the sub parts 32 are formed adjacent to the end parts of the main parts 31. The modified partitions, however, differ from those shown in FIGS. 1 and 2 in a shape of the sub parts 32.

Figure 7A:
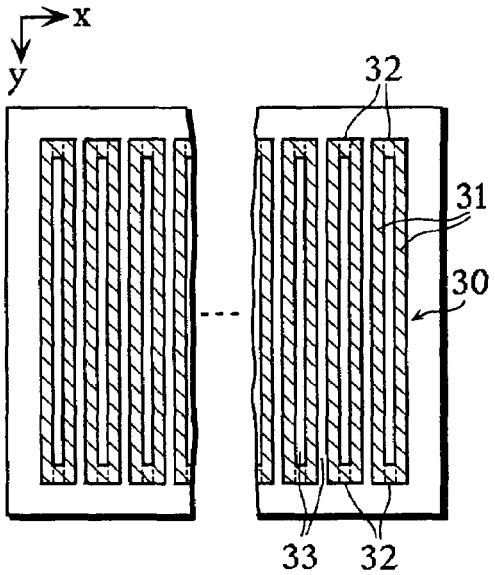
FIGS. 7A–7D show modification examples of partitions of the first embodiment.
Figure 7B:
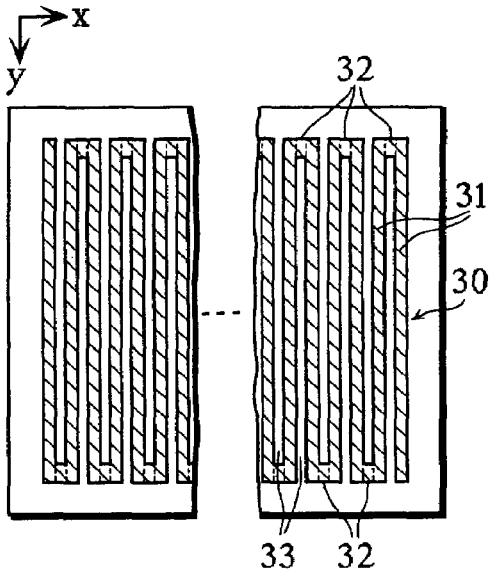

For modification partitions 30 shown in FIGS. 7A and 7B, on either the top side or the bottom side of each figure, a sub part 32 is formed in every other end of a channel 33.

In more detail, with the partitions shown in FIG. 7A, the sub parts 32 are axisymmetrically formed. This is to say, each sub part 32 is formed to connect an end part of an nth ("n" being an odd number) main part 31 and that of an (n+1)th main part 31 on both the top side and the bottom side of the figure, with a smallest ordinal number being given to a main part 31 present on the far-left edge of the figure. No sub parts 32 are formed between an end part of an mth ("m" being an even number) main part 31 and that of an (m+1)th main part 31.

With the partitions in FIG. 7A, the sub parts 32 are present at both ends of each of nth channels 33 and enclose these nth channels 33. Accordingly, it is desirable that the sub parts 32 have a lower height than central parts 31*b*of the main part 31 to allow the exhausting and discharge-gas filling process to be performed easily.

On the other hand, with the partitions 30 in FIG. 7B, sub parts 32 are not axisymmetrical formed. The sub parts 32 and the main parts 31 constitute a kind of a single partition as a whole. This is to say, on the bottom side of the figure, a sub part 32 connects an end part of an nth main part 31 with that of an (n+1)th main part 31. Similarly, on the top side, a sub part 32 connects an end part of an mth main part 31 with that of an (m+1)th main part 31.

With this partition construction, a sub part 32 only exists at one of two ends of each channel 33. Accordingly, the exhausting and discharge-gas filling process can be easily performed even when the sub parts 32 have approximately the same height as central parts 31*b* of the main parts 31.

Figure 7C:
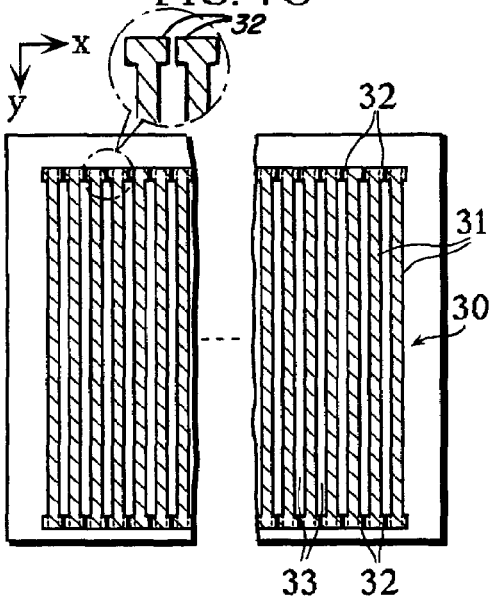
Figure 7D:
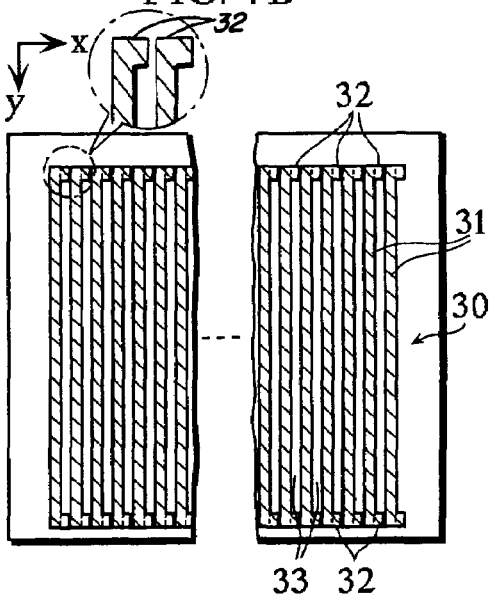

With the partitions shown in FIGS. 7C and 7D, sub parts 32 are formed in both end parts of each main part 31. The sub parts 32, however, do not connect end parts of main parts 31 with one another.

More specifically, for the partitions 30 shown in FIG. 7C, sub parts 32 extend from both end parts of each main part 31 parallel to the x-axis direction to the left and right of the figure. In other words, an end of each partition 30 has a "T" shape.

With the partitions 30 shown in FIG. 7D, sub parts 32 extend from both end parts of each main part 31 in parallel to the x-axis direction rightward, and have a shape of a letter "L".

With the above two types of partitions 30 in FIGS. 7C and 7D, both ends of each channel 33 are left open to outer space, without the sub parts 32 closing these ends. As a result, the exhausting and discharge-gas filling process can be easily performed even when the sub parts 32 have approximately the same height as the central parts 31*b* of the main parts 31.

For the above four types of partitions 30 in FIGS. 7A–7D, it is desirable that sub parts 32 have a width that is from 1.5 times to twice as large as the main parts 31 so as to make heights of end parts 31*a* and sub parts 32 lower than central parts 31*b* of main parts 31. In some cases, however, it is possible to make the end parts 31*a* and the sub parts 32 have approximately the same height as the central parts 31*b* even when a shorter width than that of main parts 31 is provided to the sub parts 32.

OTHER MODIFICATION EXAMPLES OF FIRST EMBODIMENT

In the above embodiment, the main parts 31 are described as being lineally formed parallel to the address electrodes 22. However, the main parts 31 do not have to be lineally formed. For instance, each main part 31 may zigzag along an address electrode 22, or an auxiliary partition may be formed between main parts 31 (i.e., on each of the channels 33). In either case, the same effect as obtained in the above embodiment can be achieved.

Further, the main parts 31 may be formed in a manner that their longitudinal direction becomes perpendicular to the address electrodes 22, with this being capable of achieving the same effect as described above.

SECOND EMBODIMENT

A PDP of the present embodiment has basically the same overall construction as that of the first embodiment.

The partitions of the present PDP have basically the same striped construction as the conventional partitions 130 described earlier. For the present embodiment, however, the partitions are partially heated to a temperature higher than the softening point of the partition material after the baking process so as to suppress swellings produced in end parts of the partitions.

A method for producing the present PDP is basically the same as in the first embodiment although the partition forming process differs from that of the first embodiment.

The following describes this partition forming process.

As described in the first embodiment with reference to FIG. 3, the following first to fifth steps are performed for the partition forming process: the partition layer coating step; the photosensitive layer pattern forming step; the blasting step; the covering layer removing step; and the partition baking step.

Figure 11:
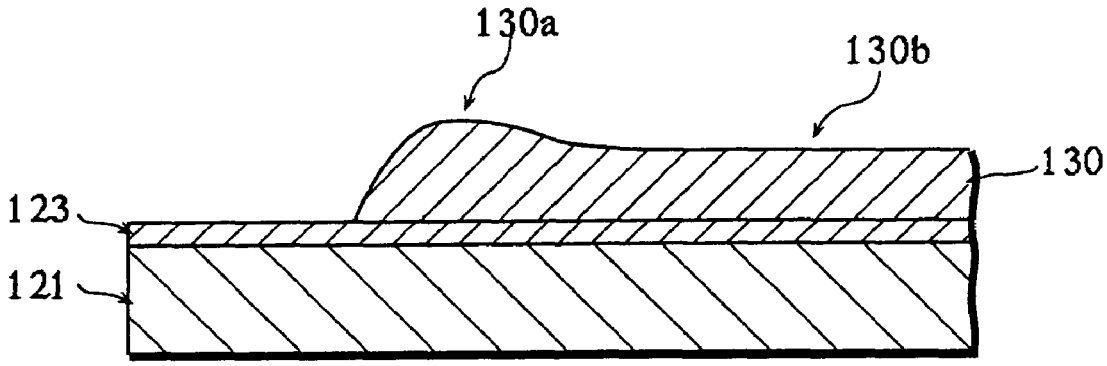
FIG. 11 PRIOR ART
FIG. 11 shows a swelled end part of the above PDP.

Immediately after the fifth step, swellings are likely to be produced in end parts of the produced partitions as has been shown in FIG. 11 for the partitions 130. Accordingly, the present partition forming process additionally includes, after the above fifth step, the sixth step, where end parts of the partitions are irradiated with a laser beam and partially heated so as to reduce swellings in their end parts.

The following describes this partial heating step of the sixth step in detail.

Figure 8:
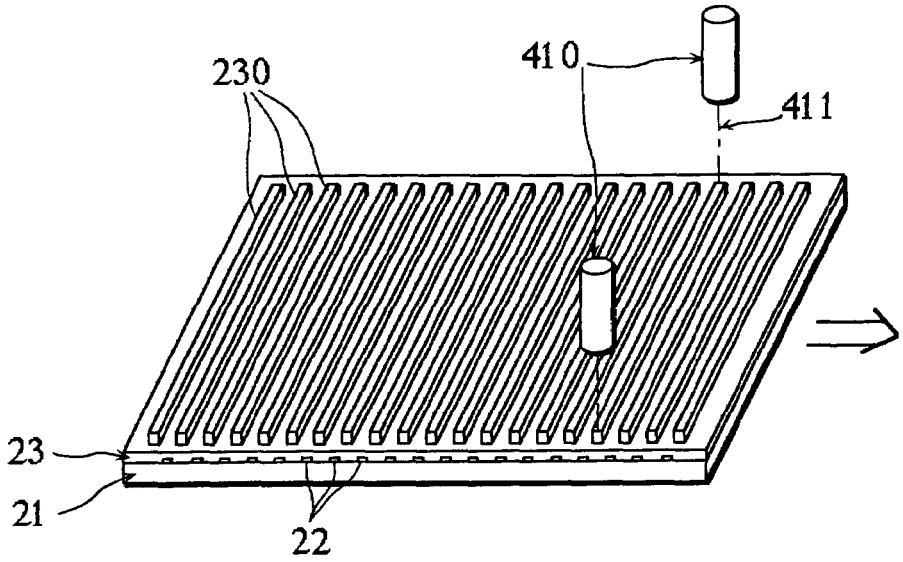
FIG. 8 shows a state in which an end part of a partition is irradiated with a laser beam for the second embodiment.

FIG. 8 shows a state in which an end part of partitions 230, which are formed on the back glass substrate 21 after the fifth step, is irradiated with a laser beam 411 emitted by a laser 410.

The laser 410 may be a YAG (yttrium aluminum garnet) laser with a power output of 30 W, a carbon dioxide ($CO_2$) laser, or the like, for instance. As shown in the figure, the back glass substrate 21 is moved with respect to the laser 410 toward a direction shown by a white arrow so as to irradiate and heat the plurality of partitions 230 one by one.

Figure 9:
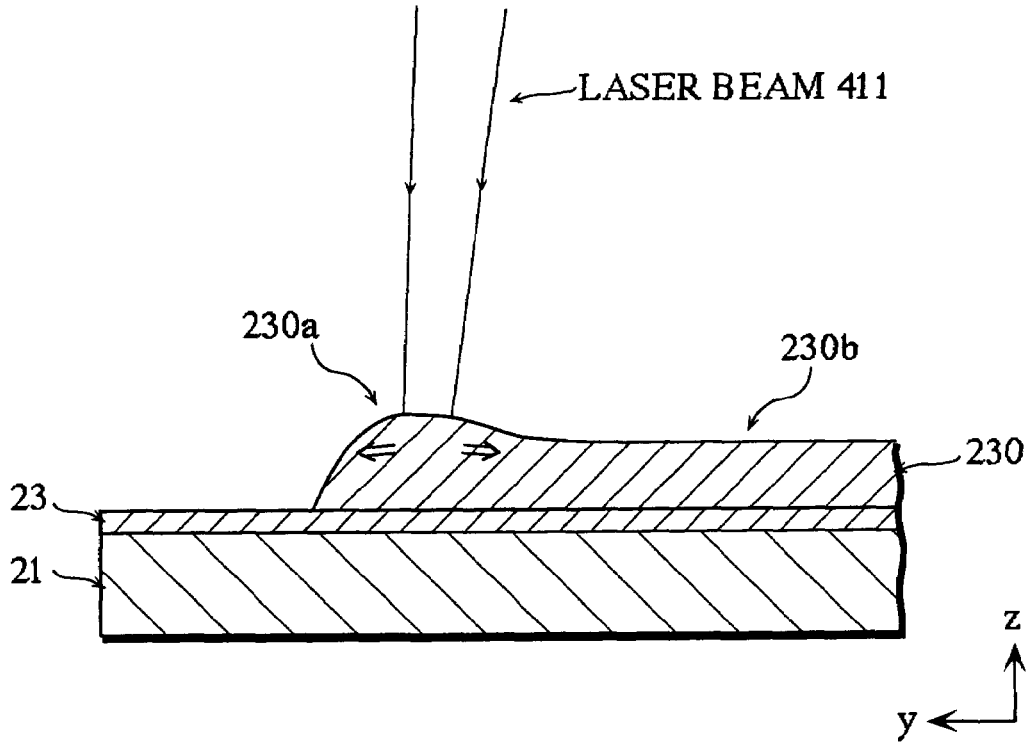
FIG. 9 shows a state in which an end part of a partition is irradiated with a laser beam.
Figure 10:
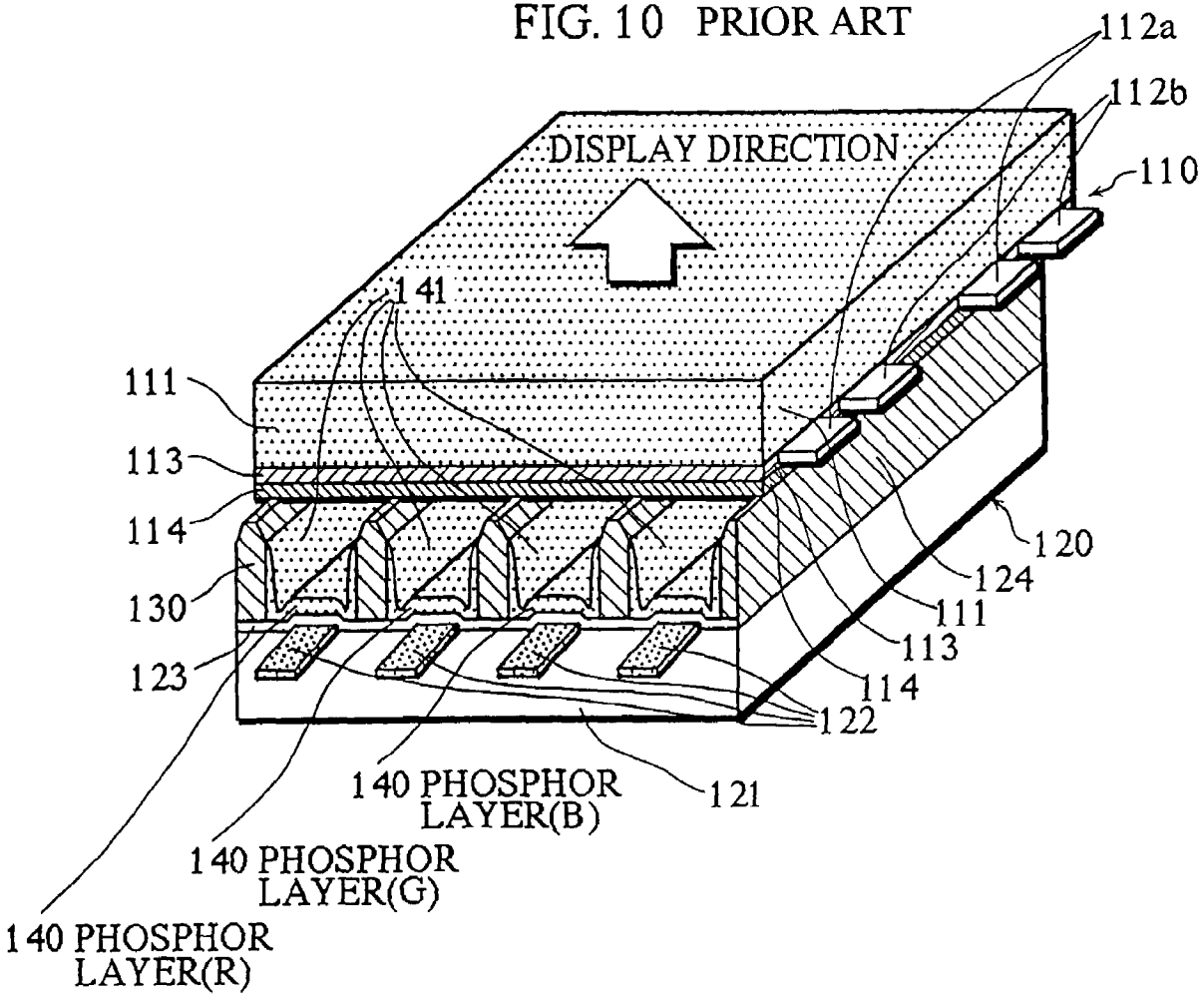
FIG. 10 PRIOR ART
FIG. 10 shows a standard AC surface-discharge PDP as one example.

FIG. 9 shows a state in which an end part 230*a* of a partition 230 is irradiated with the laser beam 411.

Immediately after the fifth step, the address electrodes 22 and the back dielectric layer 23 are formed on the back glass substrate 21, and the partitions 230 are formed in stripes on the back dielectric layer 23. In FIG. 9, the end part 230*a* swells and becomes higher than a central part 230*b* by ten to twenty percent.

Accordingly, both ends of each of the partitions 230 are irradiated with the laser beam 411 emitted from the laser 410, so that these ends are partially heated to a temperature (550° C. or higher) that is higher than the softening point of the partition material.

In this partial heating process, only the end part 230*a* is heated to the above temperature while a temperature of other parts (i.e., the central part 230*b*) of the partition 230 is kept lower than the softening point. As a result, a part softened by the above partial heating can be limited to a part where a swelling is produced and its adjacent parts.

Once the softened end part 230*a* solidifies, a shape of the end part 230*a* changes and the swelling is reduced. As such shape change gives surfacetension to the softened parts, the partition material making up the swelling disperses to its periphery as shown by white arrows in FIG. 9.

By adjusting heating conditions of this partial heating step, a shape of the end part 230*a* can be changed to make the end part 230*a* and the central part 230*b* the same height, or to make the end part 230*a* lower than the central part 230*b*.

Note that the entire end part 230*a* does not have to be heated to reduce a swelling, and a part near the surface of the end part 230*a* may only be heated to the above temperature without a part close to the bottom being heated to this temperature.

In this way, with the present embodiment, swellings produced at ends of partitions 230 during baking can be reduced by additionally performing the sixth step for partially heating partitions after the partition baking step. Accordingly, a PDP that can display high-quality images can be easily produced according to the PDP production method of the present embodiment.

In the partial heating step of the present embodiment, the partitions 230 are partially irradiated with the laser beam 411 from the above, i.e., from the side to be faced with a front panel in order to partially heat the end part 230*a*. However, the end part 230*a* may be heated by having the end part 230*a* irradiated with an electron beam, sprayed with an air flow of an elevated temperature, or come into contact with a tool heated to an elevated temperature. Also, it is not necessary to heat the partitions 230 from the above, and the partitions 230 may be heated, for instance, from the side of the back of the back glass substrate 21.

As in the first embodiment, the partitions 230 do no have to be lineally formed. Also, the partitions 230 may be arranged so as to make their longitudinal direction perpendicular to the address electrodes 22. The same result as obtained above can be achieved with these modified partitions 230.

MODIFICATION EXAMPLES FOR FIRST AND SECOND EMBODIMENTS

The first and second embodiments use the "sandblasting method" to form the partition material into a predetermined partition pattern during the partition forming process. This forming process, however, may be performed using the "printing method" with which the partition pattern formed by a partition paste is printed by the screen printing, or using the "photo-paste method" with which a photosensitive partition paste is applied onto the entire surface of the back substrate, and then unnecessary portions are removed using photography. With any of these methods, the same effect as described above can be achieved.

In the first and second embodiments, partitions are formed on the side of the back panel although the partitions may be formed on the side of the front panel with the advantage of the present invention being obtained with such construction.

The first and second embodiments use an AC surface-discharge PDP as one example of the present invention although an opposed-discharge PDP or a DC PDP may be used instead, with such PDP being capable of achieving the same effect as described above.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A plasma display panel (PDP) comprising:

a first substrate and a second substrate which face each other so that a plurality of first electrodes, arranged in parallel on the first substrate, intersect a plurality of second electrodes arranged in parallel on the second substrate, wherein a plurality of partitions are formed on a surface of the first substrate facing the second substrate, and form a plurality of spaces between the first substrate and the second substrate;

phosphor layers are positioned between the plurality of partitions;

a discharge gas is provided between the plurality of partitions; and a sealing material is provided on an outer perimeter of the first and second substrates, wherein the discharge gas is sealed in the plurality of spaces, wherein the plurality of partitions include (a) a plurality of main parts that extend parallel to the first electrodes and (b) a plurality of sub parts that each extend from an end part of one of the plurality of main parts between the main parts, parallel to a direction of a width of the plurality of main parts and connect the end parts of the main parts with one another, wherein the plurality of sub parts have a smaller Width than the width of the plurality of the main parts.

2. The PDP of claim 1, wherein the plurality of main parts each include two end parts that are a first end part and a second end part respectively on one side and on another side of the first substrate, wherein the plurality of sub connect first end pats of all the plurality of main parts with one another.

wherein the plurality of sub parts connect second end parts of all the plurality of main parts with one another.

3. The PDP of claim 1, wherein each of the plurality of sub parts has a height that is either lower than or approximately equal to a central part of each of the plurality of main parts.

4. The PDP of claim 1, wherein the plurality of sub parts are positioned on the first substrate at a position beyond the display of images between the first and second substrate.

5. The PDP of claim 4, wherein the plurality of sub parts surround the plurality of main parts and are adjacent the sealing material.

6. The PDP of claim 1, wherein the end part of each of the plurality of main parts is a part which extends from an end (31*c*) of each of the plurality of main parts in parallel to each of the main parts.

7. The PDP of claim 1, wherein the end part of each of the plurality of main parts is a part which extends from an end (3*c*) of each of the plurality of main parts in parallel to each of the main parts by a length approximately equal to a width of each of the plurality of main parts.

8. A plasma display panel PDP for displaying video images in color comprising;

a first substrate and a second substrate which face each other so that a plurality of first electrodes, arranged in parallel on the first substrate, intersect a plurality of second electrodes, arranged in parallel on the second substrate, wherein a plurality of partitions are formed on a surface of the first substrate facing the second substrate, and form a plurality of spaces between the first substrate and the second substrate;

phosphor layers are positioned between the plurality of partitions;

a discharge gas is provided between the plurality of partitions; and a sealing material is provided on an outer perimeter of the first and second substrates to extend around the plurality of partitions, wherein the discharge gas is sealed in the plurality of spaces, wherein the plurality of partitions include (a) a plurality of main parts that extend parallel to the first electrodes and (b) a plurality of sub parts that each extend from an end part of one of the plurality of main parts between the main parts, parallel to a direction of a width of the plurality of main parts and connect the end parts of the main parts with one another, wherein the plurality of sub parts have a smaller width than the width of the plurality of the main parts, the sub parts are positioned outward from a portion of the display panel.

* * * * *

UNITED STATES PATENT AND TRADEMARK OFFICE

CERTIFICATE OF CORRECTION

PATENT NO. : 7,053,552 B2
APPLICATION NO. : 10/639027
DATED : May 30, 2006
INVENTOR(S) : Yonehara et al.

It is certified that error appears in the above-identified patent and that said Letters Patent is hereby corrected as shown below:

In the Claims:
In Claim 1, Column 13, line 21, “Width” should be --width--.
In Claim 2, Column 13, line 28, insert --parts-- after “sub”.
In Claim 2, Column 13, line 28, “pats” should be --parts--.
In Claim 2, Column 13, line 29, “.” should be --,--.
In Claim 7, Column 14, line 8, “(3c)” should be --(31c)--.
In Claim 8, Column 14, line 13, “;” should be --:--.

Signed and Sealed this

Sixth Day of February, 2007

JON W. DUDAS
*Director of the United States Patent and Trademark Office*